US008622471B2

(12) United States Patent
Porter et al.

(10) Patent No.: US 8,622,471 B2
(45) Date of Patent: Jan. 7, 2014

(54) VIBRATION SEAT

(75) Inventors: Timothy John Porter, Ross-on-Wye (GB); Dilwyn Clive Davies, Brighton (GB)

(73) Assignee: Porter and Davies Limited, Brighton (GB)

( * ) Notice: Subject to any disclaimer, the term of this patent is extended or adjusted under 35 U.S.C. 154(b) by 287 days.

(21) Appl. No.: 13/020,428

(22) Filed: Feb. 3, 2011

(65) Prior Publication Data

US 2012/0080915 A1 Apr. 5, 2012

(30) Foreign Application Priority Data

Oct. 1, 2010 (GB) ..... 1016504.1

(51) Int. Cl.
*A47C 7/62* (2006.01)

(52) U.S. Cl.
USPC ..... 297/217.4; 297/273; 297/452.27

(58) Field of Classification Search
USPC ..... 297/452.27, 217.3, 217.4; 601/46, 49, 601/56, 57, 58, 59, 60, 67, 69, 70
See application file for complete search history.

(56) References Cited

U.S. PATENT DOCUMENTS

| | | | | |
|---|---|---|---|---|
| 5,615,927 | A * | 4/1997 | Kassai | 297/452.27 |
| 7,040,707 | B2 * | 5/2006 | Nakahara | 297/452.27 |
| 7,585,030 | B2 * | 9/2009 | Galbreath et al. | 297/452.27 |
| 7,905,552 | B2 * | 3/2011 | Galbreath et al. | 297/452.27 |
| 8,061,210 | B2 * | 11/2011 | Crowson, II | 73/668 |
| 8,141,957 | B2 * | 3/2012 | McClung et al. | 297/452.27 |
| 2004/0251747 | A1 | 12/2004 | Bouchard | |
| 2006/0273650 | A1 * | 12/2006 | Embach | 297/452.27 |
| 2008/0171954 | A1 | 7/2008 | Guenther et al. | |
| 2008/0309132 | A1 * | 12/2008 | Katsuta | 297/217.3 |
| 2009/0250982 | A1 * | 10/2009 | Cohen | 297/217.4 |

FOREIGN PATENT DOCUMENTS

| | | |
|---|---|---|
| CN | 2499024 | 7/2002 |
| GB | 1582577 | 1/1981 |

OTHER PUBLICATIONS

UK Combined Search and Examination Report of Jan. 27-28, 2011, (3 pages).

* cited by examiner

*Primary Examiner* — David Dunn
*Assistant Examiner* — Alexander Harrison
(74) *Attorney, Agent, or Firm* — Wegman, Hessler & Vanderburg

(57) ABSTRACT

A vibration seat (20) comprising a seat body (22), a sitting portion (24) supported by the seat body, and a vibrator (4). The sitting portion (24) is free to vibrate relative to the seat body (22). The vibrator (4) is connected to the sitting portion (24) at a single node (1) and is free to move relative to the seat body (22).

14 Claims, 2 Drawing Sheets

VIBRATION SEAT

Figure 1:
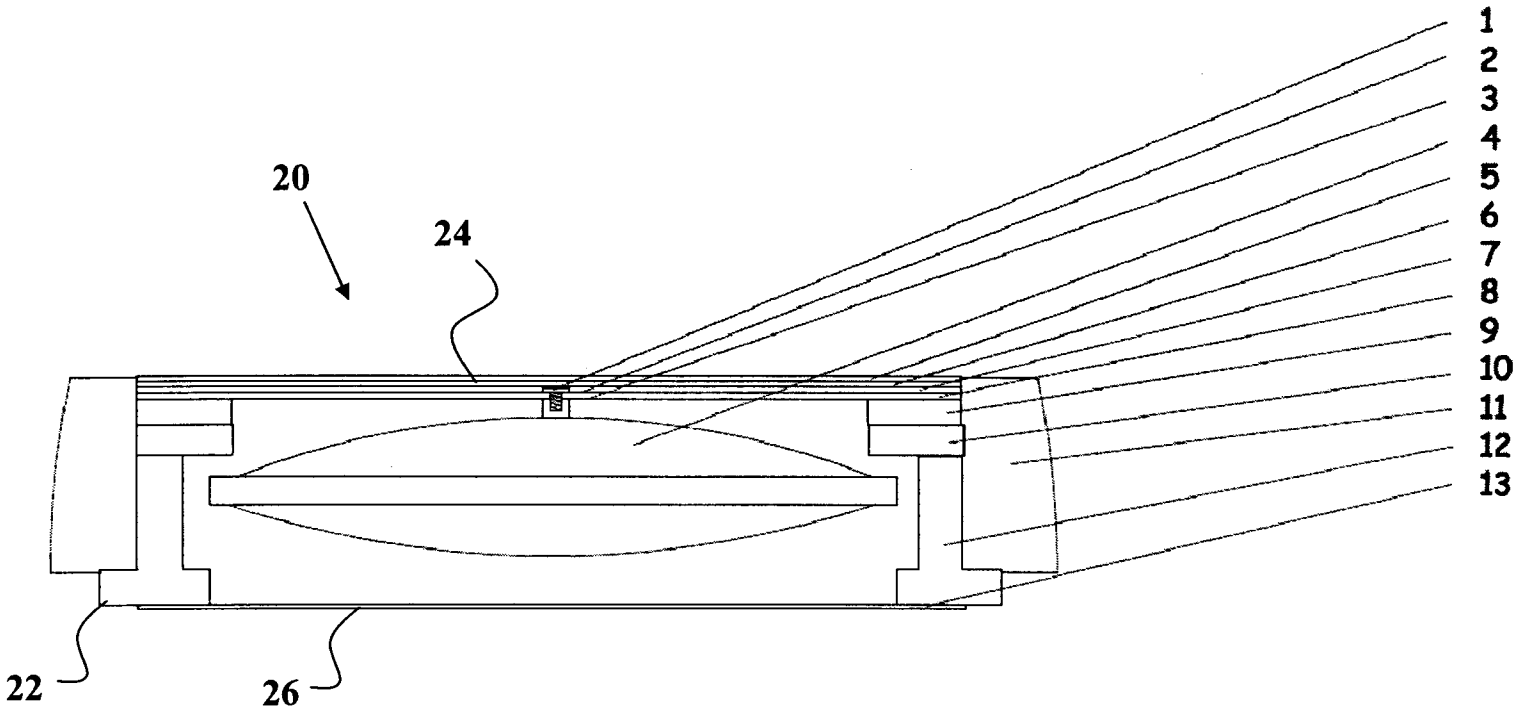

The present invention relates to a vibration seat including a vibrator.

Vibration seats known in the art include vibrators to induce vibrations in the seat; the vibrations intended to be felt by a user sitting on the seat. Such vibrations can convey useful information to the user, for example to add to a users experience in a cinema.

A known vibration seat is described in US patent publication US2004/0251747, wherein a vibrator unit is mounted on a flat and relatively rigid surface, such as the back of the seat. The vibration unit vibrates in a direction parallel to the flat surface to propagate vibrations through the flat surface and to the user.

The vibrator may require significant electrical power to drive the vibrations through the structure of the seat to the user.

Furthermore, it may be difficult to transmit vibrations of specific frequencies to the user of the seat, due to the various resonant and damping characteristics of the seat structure.

It is therefore an aim of the invention to provide an improved vibration seat.

According to an embodiment of the invention, there is provided a vibration seat comprising a seat body, a sitting portion supported by the seat body, and a vibrator, wherein the sitting portion is free to vibrate relative to the seat body, and wherein the vibrator is connected to the sitting portion at a single node and is free to move relative to the seat body.

The sitting portion "floats" on the seat body and so is free to vibrate relative to the seat body. Since the vibrator is connected to the sitting portion at a single node and is free to move relative to the seat body, substantially all the vibration energy from the vibrator is transmitted to the sitting portion and generates vibrations in the sitting portion that may be felt by a user. The vibrator may be supported only by the single node to help make the vibrator free to move relative to the seat body and help prevent vibration energy from being absorbed by the seat body. The vibrator may be a vibration transducer that converts electrical energy into vibration energy.

The single node may assist in transmitting vibrations of the desired frequency to the user, and may enable the vibrations to be applied to a specific point on the sitting portion. Furthermore, the single node may enable travelling waves to be set up across the sitting portion, and the absence of any further nodes (contact points) between the vibrator and the sitting portion may prevent the travelling waves from being interfered with by energy that would originate from the further nodes, if further nodes were present.

Advantageously, the sitting portion may be mounted on a foam portion of the seat body to help isolate the resonant/damping characteristics of the remainder of the seat from the sitting portion.

The sitting portion may be fixed to the seat body only at a periphery of the sitting portion to help make the sitting portion free to vibrate relative to the seat body.

Advantageously, the sitting portion may be a laminate structure, one of the laminate layers being a laminate actuator plate layer for transmitting vibrations from the single node across the sitting area, and another of the laminate layers being a foam layer above the actuator plate layer. The foam layer may provide a soft surface for the user to sit on, and may be comprised of lower and upper foam layers.

The laminate structure may comprise spreader plate layers below and/or above the laminate actuator plate layer. The spreader plate layers may help improve the stiffness of the sitting portion around the critical node point, lowering mechanical stress on the laminate actuator plate layer and improving transmission of vibrations.

The laminate structure may include a textured actuator plate layer to provide an interface between the laminate actuator plate layer and the foam layer. The textured upper surface of the textured actuator plate layer allows the foam layer a greater surface area to bond to, further improving the transmission of vibrations.

The single node may comprise a fixing bolt between the vibrator and the laminate actuator plate layer, and the textured actuator plate layer may have a machined pocket that the bolt head is 'lost' into, affording greater comfort to the user.

Figure 2:
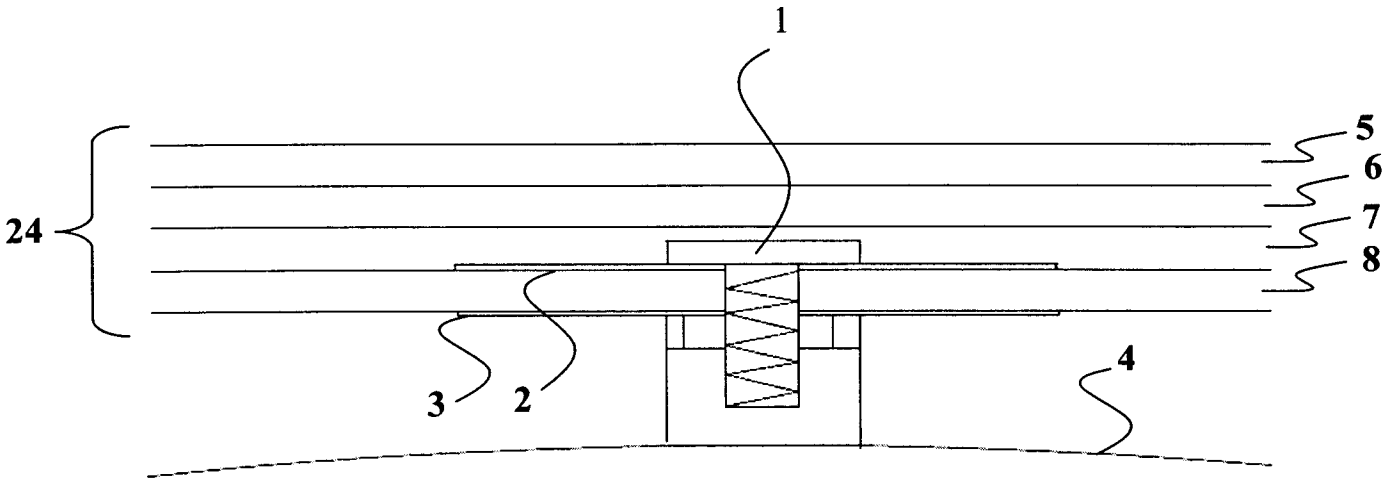

Embodiments of the invention will now be described with reference to the accompanying drawings, in which:

FIG. 1 shows a schematic cross-sectional diagram of a vibration seat according to an embodiment of the invention; and FIG. 2 shows a more detailed schematic diagram of a laminate structure and node of the embodiment of FIG. 1.

The schematic diagrams of FIG. 1 and FIG. 2 show a vibration seat 20 according to an embodiment of the invention. The vibration seat may for example be incorporated in stools, chairs, sofas etc.

The vibration seat 20 has a seat body 22 and a sitting portion 24. The seat body 22 is formed by a substantially circular member 12 and a metal base plate 13, and has a suspension foam on the circular member 12 for supporting the sitting portion. The suspension foam is formed of two laminate layers 9 and 10, the upper layer 9 being more easily compressible than the lower layer 10. The circular member 12 is formed of wood, although the use of other materials such as metal is also possible. In an alternate embodiment, the suspension foam may be replaced by an elastic web connected between the periphery of the sitting portion and the seat body, for example the substantially circular member 12. The seat body 22 is provided with outer padding foam 11 externally surrounding the circular member 12 and the suspension foam.

The sitting portion 24 and the seat body 22 form a closed cavity in which the vibrator 4 is housed. The vibrator 4 generates vibrations in a direction perpendicular to the sitting portion 24. Vibrators capable of producing such vibrations are commercially available, as will be apparent to those skilled in the art.

The vibrator 4 is connected to the sitting portion by a fixing bolt 1, the fixing bolt forming a single node for transmitting vibration energy to the sitting portion 24.

As best seen from FIG. 2, the sitting portion 24 is a laminate structure having a lower spreader plate layer 3, a laminate actuator plate layer 8 on the lower spreader plate layer 3, an upper spreader plate layer 2 on the laminate actuator plate layer 8, a textured actuator plate layer 7 on the upper spreader plate layer 2, a lower foam layer 6 on the textured actuator plate layer 7, and an upper foam layer 5 on the lower foam layer 6.

The laminate actuator plate layer 8 is a relatively stiff layer that transmits vibration energy over the laminate structure (sitting area), and in this particular embodiment the laminate actuator plate layer 8 is a high density, resin impregnated, pressure bonded particle board with a solid resin upper and lower surface. Further embodiments using different materials or construction techniques for the laminate actuator plate layer will be apparent to those skilled in the art.

The lower and upper spreader plate layers are present at the fixing bolt to provide mechanical support to the laminate actuator plate layer. In this particular embodiment the spreader plate layers extend over a portion of around 10% of the area of the laminate structure. In other embodiments, the area of the lower and upper spreader plate layers may be less than or more than 10% of the area of the laminate structure, for example less than 50% of the area of the laminate structure depending on the degree of support required by the laminate actuator plate layer.

In still other embodiments, the actuator plate layer is sufficiently strong to not require any spreader plate layers. For example, in an alternate embodiment the laminate actuator plate layer comprises ribs that extend outwards from the single node to strengthen the laminate actuator plate layer and negate the need for spreader plates. In this alternate embodiment, the laminate actuator plate is formed from cast aluminium, although other materials are possible. For example, in the FIG. 2 embodiment, the lower and upper spreader plate layers are made from 16/6 grade stainless steel.

The textured actuator plate layer 7 provides an interface between the laminate actuator plate layer and the foam layers 6 and 7. The textured upper surface of the textured actuator plate layer allows the foam layer 6 a greater surface area to bond to, further improving the transmission of vibrations. In this embodiment, the textured actuator plate layer is a medium density, long fibre, impregnated and pressure bonded fibreboard.

The foam layers 6 and 7 aim to provide a soft surface for the user to sit on, whilst also aiming to maintain good transmission of vibrations. In this embodiment, the lower foam layer 6 is a reconstituted foam containing granules of high density foam held in a suspension of lower density foam particles. The act of a user sitting on these compresses the lower density particles, allowing the high density granules to transmit the vibrations effectively while affording a reasonable level of 'squishy-ness' and comfort to the user. The upper layer 7 is a thin expanded neoprene that evens out the slightly 'lumpy' reconstituted foam layer 6 without significantly reducing transmission efficiency. Other types of foam layer arrangements will also be apparent to those skilled in the art.

The head of the fixing bolt 1 is held within a machined pocket of the textured actuator plate layer 7 of the laminate structure, and the end of the fixing bolt is held in the vibrator, for example by a screw thread or corresponding bolt. The vibrator is entirely supported by the fixing bolt, such that the vibrator is free to move within the body of the vibration seat. Furthermore, the fixing bolt is positioned at the centre of the sitting area, to help prevent vibration energy from the fixing bolt being unnecessarily damped by the suspension foam 9 and 10 of the seat body.

The fixing bolt may alternatively be replaced by other means for transmitting the vibration energy, for example nails, pins or rods. The vibrator may alternately be directly in contact with the sitting portion, for example by attaching a portion of the vibrator to the sitting portion by an adhesive.

In use, the vibration actuator 4 vibrates in a direction perpendicular to the sitting portion, and the fixing bolt 1 transmits the vibration to the sitting portion, setting up transverse travelling waves across the sitting portion. The travelling waves can be felt by a user sitting on the sitting portion.

Different frequency vibrations may be transmitted by the vibrator to communicate various information to the user. For example, the user may be a drummer, and the sounds created by the drummer may be replicated as vibrations by the vibrator, enabling the drummer to sense what sounds the drummer is creating. The sounds may be sensed by a microphone and transmitted to the vibrator, for example by a wireless communication method. The sounds sensed by the microphone may be processed by the microphone and/or a controller before they are sent to the vibrator. The vibrator 4 is a vibration transducer that converts electrical energy to vibration energy.

In this embodiment, the sitting portion is substantially circular (for example a circle or an oval), although in other embodiments the sitting portion may take other shapes such as rectangles or triangles. The substantially circular (or non-angular) shape of the sitting portion 24 may help reduce distortions in the travelling waves that may for example occur due to discontinuities in the reflections around the periphery of the sitting portion.

The scope of the invention is defined by the appended independent claim(s). Further features appearing in the dependent claims and the description are only optional and may or may not be implemented in various embodiments of the invention which will be apparent to those skilled in the art.

The invention claimed is:

1. A vibration seat comprising a seat body, a sitting portion supported by the seat body, and a vibrator for replicating sounds as vibrations, wherein the sitting portion is free to vibrate relative to the seat body, wherein the vibrator is connected to the sitting portion at a single node and is free to move relative to the seat body, and wherein the sitting portion is a laminated structure, the laminated structure comprising an actuator plate layer and a foam layer above the actuator plate layer, a spreader plate layer below the actuator plate layer, and a further spreader plate layer between the actuator plate layer and the foam layer, wherein the spreader plate layer is present at the single node and only over a portion of less than 50% of the area of the laminated structure, and wherein the further spreader plate layer is present at the single node and only over a portion of less than 50% of the area of the laminated structure.

2. The vibration seat of claim 1, wherein the vibrator is supported only by the single node connected to the sitting portion.

3. The vibration seat of claim 1, wherein the vibrator is housed within a cavity of the vibration seat.

4. The vibration seat of claim 1, wherein the sitting portion is fixed to the seat body only at the periphery of the sitting portion.

5. The vibration seat of claim 1, wherein the single node is at the centre of the sitting portion.

6. The vibration seat of claim 1, wherein the laminated structure further comprises a textured actuator plate layer between the further spreader plate layer and the foam layer.

7. The vibration seat of claim 1, wherein the single node comprises a fixing bolt connected between the sitting portion and the vibrator.

8. The vibration seat of claim 6, wherein the single node comprises a fixing bolt connected between the sitting portion and the vibrator, and wherein the head of the fixing bolt is located within the textured actuator plate layer.

9. The vibration seat of claim 1, wherein the seat body comprises a suspension foam, the sitting portion being mounted on the suspension foam.

10. The vibration seat of claim 9, wherein the suspension foam comprises two layers of foam, one layer of foam being less compressible than the other layer of foam.

11. The vibration seat of claim 10, wherein the seat body comprises supports that support the suspension foam and house the vibrator.

12. The vibration seat of claim 11, wherein the supports are externally surrounded by padding foam.

13. The vibration seat of claim 11, wherein the supports comprise a substantially circular member having a base plate, the circular member and the base plate housing the vibrator.

14. The vibration seat of claim 1, wherein the vibrator is arranged to vibrate in a direction perpendicular to the sitting portion.

* * * * *